United States Patent [19]

Springer

[11] Patent Number: 4,687,437

[45] Date of Patent: Aug. 18, 1987

[54] DISPOSABLE LIGHTER

[76] Inventor: Joseph Springer, P.O. Box 571, Onley, Va. 23418

[21] Appl. No.: 844,032

[22] Filed: Mar. 25, 1986

[51] Int. Cl.[4] ..... F23Q 1/02

[52] U.S. Cl. ..... 431/277; 431/343; 431/344

[58] Field of Search ..... 431/343, 254, 276, 277, 431/344, 142, 143, 150

[56] References Cited

U.S. PATENT DOCUMENTS 3,234,762 2/1966 Ohno ..... 431/344

3,484,178 12/1969 Weissmann ..... 431/343

3,938,947 2/1976 Rosenthal ..... 431/344

4,325,692 4/1982 Kitabayashi ..... 431/344

*Primary Examiner*—Carroll B. Dority, Jr.

*Attorney, Agent, or Firm*—James C. Wray

[57] ABSTRACT

A disposable lighter has an elongated body and an L-shaped clip that has a dual purpose of actuating a release valve for gaseous fuel and securing the lighter within a user's pocket. Simplicity in design renders the device easy to manufacture, reliable in performance, and disposable after exhaustion of the fuel supply.

7 Claims, 6 Drawing Figures

DISPOSABLE LIGHTER

BACKGROUND OF THE INVENTION

The present invention relates to lighters and more specifically relates to a disposable lighter of the type that uses a liquid fuel stored under pressure which is burned in a gaseous state after a pressure drop as for instance, when a valve is opened to release the fuel.

Butane lighters have been known for many years. Butane is a prefered fuel because of its boiling point of 1 degree C. By liquefying the butane fuel supply, a lighter can maintain a reservoir of fuel in a liquid state and burn fuel in a gaseous state, thereby increasing the fuel capacity of the lighter.

Prior art attempts to develop inexpensive and practical lighters have proven unsuccessful. In particular, no prior art reference teaches or suggests a clip having a dual purpose.

U.S. Pat. No. 4,177,646 teaches a gas lighter utilizing a vaporizer-pressure reducer assembly that includes a pressure reducing device situated generally within a vaporizer. The device does not show means for actuating the fuel release valve.

U.S. Pat. No. 4,289,478 teaches another fuel release valve having means to limit pressure. The patent shows that liquid gas within a gas tank passes through a wick and further passes between upper end faces of a heat collecting metal tube.

Others have attempted to solve the problem of lighting a gaseous fuel such as by a piezoelectric crystal shown in U.S. Pat. No. 3,541,360. However, piezoelectric starting elements tend to be costly and for that reason are not likely to be used in disposable lighters.

U.S. Pat. No. 3,556,703 shows a reuseable lighter that has a detachable fuel supply element. The device cannot be disposable because of the complexity of the fuel release valve. Moreover, the device is cumbersome to operate because a user must hold the device, rotate the flint and depress the button provided at the top of the device, all at the same time.

Other references such as U.S. Pat. No. 4,235,589 tend to show that gas permeable elements or wicks are well known and can be used as pressure limiting devices. However, U.S. Pat. No. 4,235,589 does not show a specific structure using the gas permeable element.

SUMMARY OF THE INVENTION

The present invention obviates the problem associated with the prior art by providing an inexpensive, disposable lighter in which valve actuation can be achieved through the same element used to secure the device within a user's shirt pocket.

An object of the invention is to provide a lighter with a liquid fuel reservoir disposed within a generally cylindrical body, valve means disposed at an upper end of the liquid fuel reservoir for releasing fuel from within the reservoir in a gaseous state through a nozzle extending upwardly from the reservoir, spark generating means disposed adjacent the nozzle for lighting gaseous fuel escaping the reservoir through the nozzle, valve actuating means, connected to the nozzle, for selectively opening and closing the valve means, and clip means, connected to the body adjacent the spark generating means, for releasably connecting the lighter to a user's clothing.

In a preferred embodiment, the body further comprises upwardly extending support arms disposed on a top of the body on diametrically opposite sides thereof.

In another preferred embodiment, the spark generating means comprises a flint mounted adjacent the nozzle and a strike wheel journaled between the support arms for rotation therebetween in a counter-clockwise direction, an outer peripheral edge of the strike wheel extending slightly beyond a sidewall of the body.

In another embodiment, the valve actuating means and clip means are combined in the form of an L-shaped element having a shorter segment pivotally connected at the top of the body, the shorter segment having a medial opening through which the nozzle is fitted to provide an interconnection between the nozzle and the shorter segment, and a longer segment at right angle to the shorter segment, extending longitudinally along the body and terminating in a headed portion that passes against the body, whereby movement of the L-shaped element translates into movement of the nozzle which acts to seat or unseat a valve within the valve means.

In another embodiment, the device includes spring biasing means, disposed between the headed portion of the larger segment of the L-shaped element and the body, for maintaining the position of the L-shaped element.

In another embodiment, the valve means comprises a first chamber having an inlet in communication with the reservoir and an outlet in communication with a second chamber, a valve assembly having a valve disposed within the first chamber and being seated over the first chamber outlet, a hollow valve stem extending upwardly from the valve and passing vertically through the second chamber and through an opening provided at a top of the second chamber, a seal being provided between the valve stem and the opening, a spring disposed with the second chamber urging the valve into the seated position, an opening provided in a sidewall of the valve stem, the nozzle of the lighter comprising a portion of the valve stem extending beyond the opening of the second chamber, whereby downward movement of the nozzle unseats the valve to provide a pressure drop in the first chamber which is communicated to the second chamber, the liquid fuel gasifying due to the pressure drop and escaping in gaseous form through the outlet of the first chamber, the opening provided on the valve stem and out the nozzle.

In another embodiment the valve is provided with a annular seal.

In another embodiment the first and second chambers comprise a first cylindrical insert threadedly secured within an upper portion of the lighter body, the cylindrical insert having an open bottom and for receiving in a snap fit a second cylindrical insert having an open bottom end and an opposite closeable top end, the closeable top end providing a divider between the first and second chambers.

DETAILED DESCRIPTION OF THE DRAWINGS

Referring to FIGS. 1 through 4, a lighter 1 has an elongated body 2 that is preferably cylindrical in shape. Other shapes, however, may be used without deviating from the scope of the invention. The body 2 houses a liquid fuel reservoir (not shown), preferably butane, which remains in a liquid state during storage and converts to a gaseous state when released for combustion.

Figure 1:
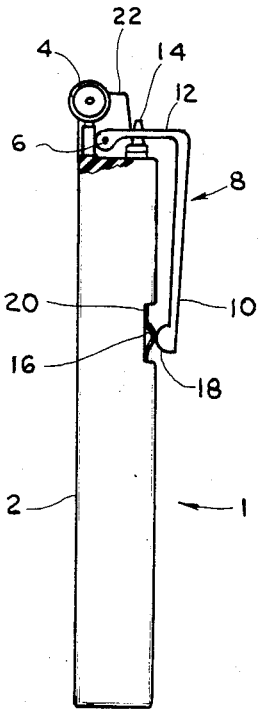
FIG. 1 is an elevation view with a portion removed for viewing purposes.

FIG. 1 shows a conventional arrangement of flint and strike wheel 4 used to ignite the gaseous fuel. Preferably, the strike fuel is rotated in a counter-clockwise direction to throw a spark in the direction of nozzle 14.

Nozzle 14 is of the type that is integral with valve means such that movement of the nozzle 14 causes an unseating of a valve to release fuel.

Figure 2:
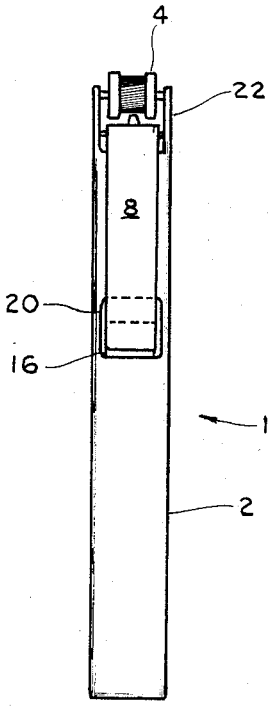
FIG. 2 is a side elevation view.

In a preferred embodiment, a pin 6 is used to pivotally mount an L-shaped clip between two parallel support arms 22. Also, as shown in FIG. 2, the strike wheel 4 is journaled for rotary movement between the two support arms.

The L-shaped clip 8 has a relatively long segment 10 and a relatively short segment 12. Segment 10 extends vertically and substantially parallel to the body 2 while segment 12 extends horizontally and substantially perpendicular to the body 2.

Figure 3:
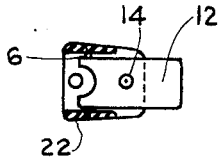
FIG. 3 is a top plan view, partially in section.
Figure 4:
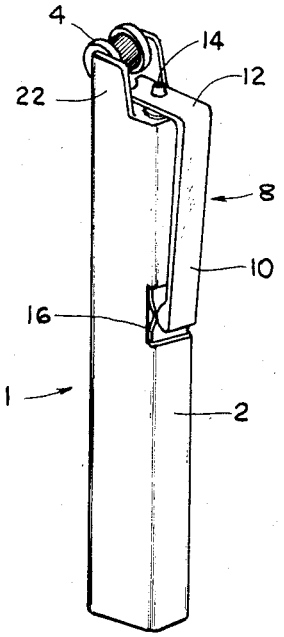
FIG. 4 is a perspective view of the device of the preceeding figures.

As shown in FIG. 3 the segment 12 is provided with an opening through which the nozzle 14 may extend. The nozzle 14 is shaped to interlock with the L-shaped clip such that movement of the clip translates into movement of the nozzle. More specifically, pivotal movement of the clip translates to reciprocating movement for the nozzle.

Actuation of the valve by pivotally moving the L-shaped clip 8 is preferably done by pivoting the clip downwardly so as to depress the nozzle 14. Only slight downward movement is required to unseat the valve and thereby release fuel from the reservoir.

Spring biasing means may be interposed between the clip and the body to encourage the clip and nozzle back to original positions. To this end, a leaf spring 16, or other suitable spring means, pushes against a headed portion 18 or the L-shaped clip 8. The leaf spring 16 is fitted into a recess 20 provided in a side wall of the body 2 opposite the headed portion 18 of the L-shaped clip.

Figure 5:
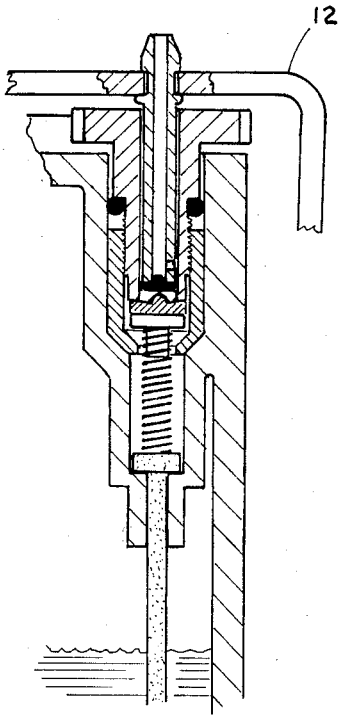
FIG. 5 is a cross sectional view of a valve utilizing the present invention.

FIG. 5 shows one embodiment of the valve means in detail. As previously mentioned, the segment 12 of the L-shaped clip is provided with a hole through which the nozzle extends. The nozzle is shaped to fit into the hole and move with the segment 12. As the nozzle moves downwardly, an end portion thereof pushes a valve out of a seated position to allow gaseous fuel to escape through a side port of the nozzle and out the opposite open end of the nozzle for combustion. Therefore, the valve means of the present invention contemplates a downward moving nozzle that unseats a valve from a seated position.

Figure 6:
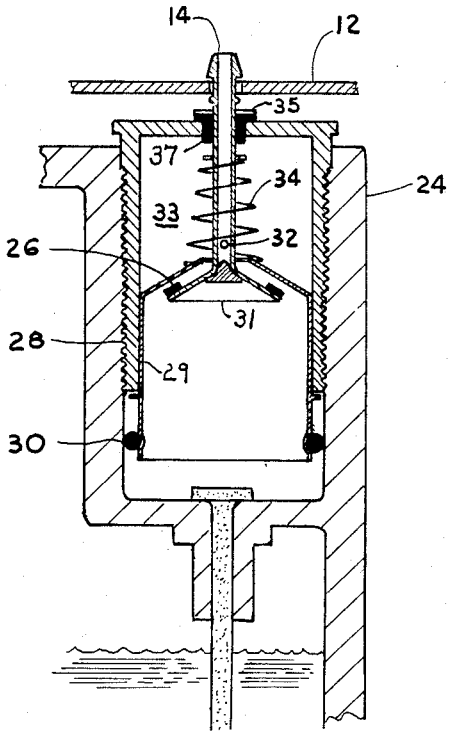
FIG. 6 is a cross sectional view of a preferred valve using the present invention.

FIG. 6 shows the preferred valve means in detail. A valve assembly is threaded into a valve assembly receiving portion 24 of the body 2.

A first cylindrical element 28 is provided with an open end for receiving a second cylindrical element 29.

The second cylindrical element 29 has a closed end that has a truncated cone shape. At the apex, an opening is provided for passage of the lower end portion of the nozzle 14. The lower end portion of the nozzle 14 is provided with a valve 31 which is preferably provided with a seal 26 along the circumference thereof. The valve shown in FIG. 6 is in an open position whereby segment 12 has moved the nozzle 14 in a downward direction to lift the valve off the truncated cone-shaped portion of the second cylindrical element 29. In so doing, gaseous fuel escapes, preferably through a wick element, into a chamber defined by the interior of the second cylindrical element 29, through the opening of the closed end of the cylindrical element 29 and into a second chamber 33, which is defined by a space between the closed end of the first cylindrical element and the closed end of the second cylindrical element. Gas accumulating in the second chamber 33 escapes through aperture 32 into the nozzle 14 and ultimately leaves the valve assembly for combustion. A spring 34 is provided to urge the valve 31 back into a seated position after use.

Preferably, the nozzle passes through an opening at the closed end of the first cylindrical element 28 having a size sufficient in diameter to allow the passage of an annular element 35 that is used to compress a rubber bushing 37 upon valve actuation.

To assemble the valve assembly of FIG. 6, elements 28 and 29 are preferably fitted together before the partial assembly is inserted into the body portion 24. Since the nozzle is preferably assembled with the second cylindrical element 29 prior to assembly of elements 28 and 29, the annular element 35 must pass through the opening provided in the closed end of the cylindrical element 28. This may not be necessary if the element 35 can be assembled to the nozzle after assembly of all of the other pieces.

Annular seal 30 is preferably disposed at the open end of the second cylindrical element 29 in order to prevent gas from leaking around the threaded connection of the body portion 24 to the first cylindrical element 28.

To use the device of the present invention, the lighter is held in one hand and the strike wheel 4 can be rotated with the thumb, while the L-shaped clip 8 is depressed with the remaining fingers.

Other variations and modifications may be made within the scope of this invention. While the disposable lighter has been described with reference to specific embodiments, it will be obvious that modifications and variations may be constructed without departing from the scope of the invention. The scope of the invention is defined in the following claims.

I claim:

1. A lighter comprising, a liquid fuel reservoir disposed within a generally elongated cylindrical body, valve means disposed at an upper end of the liquid fuel reservoir for releasing fuel from within the reservoir in a gaseous state through a nozzle extending upwardly from the reservoir, spark generating means disposed adjacent the nozzle for lighting gaseous fuel escaping the reservoir through the nozzle, valve actuating means, connected to the nozzle, for selectively opening and closing the valve means, and said valve actuating means including clip means, connected to the body adjacent the spark generating means, for releasably connecting the lighter to a user's clothing, wherein the valve actuating means and clip means are combined in the form an an L-shaped element having a shorter segment pivotally connected at the top of the body, the shorter segment having a medial opening through which the nozzle is fitted to provide an interconnection between the nozzle and the shorter segment, and a longer segment at right angle to the shorter segment, extending longitudinally along the body and terminating in a headed portion that passes against the body, means pivotally mounting the shorter segment to the body at an end of said shorter segment remote from said longer' segment, whereby movement of the L-shaped element translates into movement of the nozzle which acts to seat or unseat a valve within the valve means.

2. The apparatus of claim 1 wherein the body further comprises upwardly extending support arms disposed on a top of the body on diametrically opposite sides thereof.

3. The apparatus of claim 2 wherein the spark generating means comprises a flint mounted adjacent the nozzle and a strike wheel journaled between the support arms for rotation therebetween in a counter-clockwise direction, an outer peripheral edge of the strike wheel extending slightly beyond a sidewall of the body.

4. The apparatus of claim 1 further comprising spring biasing means, disposed between the headed portion of the larger segment of the L-shaped element and the body, for maintaining the position of the L-shaped element.

5. The apparatus of claim 4 wherein the valve means comprises, a first chamber having an inlet in communication with the reservoir and an outlet in communication with a second chamber, a valve assembly having a valve disposed within the first chamber and being seated over the first chamber outlet, a hollow valve stem extending upwardly from the valve and passing vertically through the second chamber and through an opening provided at a top of the second chamber, a seal being provided between the valve stem and the opening, a spring disposed with the second chamber urging the valve into the seated position, an opening provided in a sidewall of the valve stem, the nozzle of the lighter comprising a portion of the valve stem extending beyond the opening of the second chamber, whereby downward movement of the nozzle unseats the valve to provide a pressure drop in the first chamber which is communicated to the second chamber, the liquid fuel gasifying due to the pressure drop and escaping in gaseous form through the outlet of the first chamber, the opening provided on the valve stem and out the nozzle.

6. The apparatus of claim 5 wherein the valve is provided with a annular seal.

7. The apparatus of claim 5 wherein the first and second chambers comprise a first cylindrical insert threadedly secured within an upper portion of the lighter body, the cylindrical insert having an open bottom and for receiving in a snap fit a second cylindrical insert having an open bottom end and an opposite closeably top end, the closeable top end providing a divider between the first and second chambers.

* * * * *